US006144003A

United States Patent [19]

Kamishima

[11] Patent Number: 6,144,003

[45] Date of Patent: Nov. 7, 2000

[54] MEMBRANE SWITCH

[75] Inventor: Osamu Kamishima, Toyama, Japan

[73] Assignee: SMK Corporation, Tokyo, Japan

[21] Appl. No.: 09/437,297

[22] Filed: Nov. 9, 1999

[30] Foreign Application Priority Data

Jun. 17, 1999 [JP] Japan ..... 11-170563

[51] Int. Cl.[7] ..... H01H 13/70

[52] U.S. Cl. ..... 200/515; 200/5 A

[58] Field of Search ..... 200/5 A, 511–517

[56] References Cited

U.S. PATENT DOCUMENTS

| | | | |
|---|---|---|---|
| Re. 31,332 | 8/1983 | Larson | 200/5 A |
| 4,365,130 | 12/1982 | Christensen | 200/306 |
| 4,415,780 | 11/1983 | Daugherty et al. | 200/5 A |
| 4,916,262 | 4/1990 | Jungels-Butler et al. | 200/5 A |
| 4,931,601 | 6/1990 | Lavender | 200/83 N |
| 5,969,320 | 10/1999 | Leeper et al. | 235/380 |

*Primary Examiner*—Michael Friedhofer
*Attorney, Agent, or Firm*—Armstrong, Westerman, Hattori, McLeland & Naughton

[57] ABSTRACT

A switch storing chamber (8) of a membrane switch is communicated with the exterior and no water droplet enters the switch storing chamber (8). At least one upper gas permeable chamber (5*c*) (5*d*) is formed between an upper membrane sheet (2) and a spacer sheet (3) by surrounding a peripheral portion of this upper gas permeable chamber by adhesive material layers (9) (13), and at least one lower gas permeable chamber (5*a*) (5*b*) is formed between a lower membrane sheet (4) and the spacer sheet (3) by surrounding a peripheral portion of this lower gas permeable chamber by the adhesive material layers (9) (13). The upper gas permeable chamber (5*c*) (5*d*) and the lower gas permeable chamber (5*a*) (5*b*) partially overlap each other in a vertical direction and communicate with each other by a gas permeable hole (15) of the spacer sheet (3) bored in an overlapping position so that a gas permeable passage (5) vertically curved in a zigzag shape is formed. One side of the gas permeable passage (5) communicates with the exterior and the other side communicates with the switch storing chamber (8). The gas permeable passage (5) communicates the switch storing chamber (8) with the exterior and is vertically curved in a complicated zigzag shape through the spacer sheet (3) so that a water droplet entering from the exterior is interrupted.

4 Claims, 15 Drawing Sheets

MEMBRANE SWITCH

BACKGROUND OF THE INVENTION

1. Field of the Invention

This invention relates to a membrane switch utilized as e.g., a keyboard of a note type personal computer, and particularly relates to a waterproof membrane switch in which no water droplet enters the interior of the membrane switch even when the membrane switch is wet with water.

2. Description of the Background Art

A membrane switch having a laminating structure of flexible membrane sheets is arranged as a keyboard for inputting data in a portable device such as a portable note type personal computer.

As shown in FIG. 17, this conventional membrane switch 100 has an upper membrane sheet 101, a spacer sheet 102 and a lower membrane sheet 103 each constructed by a flexible polyester film having about 0.1 mm in thickness. A pressure sensitive adhesive is coated between these sheets so that an adhesive material layer 104 is interposed between these sheets and the three sheets 101, 102 and 103 are laminated with each other.

Plural through holes 106 are bored in the spacer sheet 102. Upper and lower portions of these through holes 106 are covered with the upper membrane sheet 101 and the lower membrane sheet 103 so that plural switch storing chambers 105 are formed. A movable electrode 101*a* is printed on a lower face of the upper membrane sheet 101 facing each of the switch storing chambers 105. Further, a fixing electrode 103*a* constituting a pair together with the movable electrode 101*a* is printed on an upper face of the lower membrane sheet 103 opposed to this movable electrode 101*a*.

Each movable electrode 101*a* and each fixing electrode 103*a* are connected to the exterior of the switch by an unillustrated lead portion. When the upper membrane sheet 101 above the switch storing chamber 105 is pressed, the movable electrode 101*a* comes in contact with the fixing electrode 103*a* and switch operating data of this switch storing chamber 105 are outputted to the exterior.

In this pressing operation, no air within the switch storing chamber 105 flows out in a sealing state in which the switch storing chamber 105 is interrupted from the exterior. Therefore, no movable electrode 101*a* reaches the fixing electrode 103*a* unless the upper membrane sheet 101 is strongly pressed. Accordingly, no membrane switch is easily operated. In contrast to this, when an external atmospheric pressure is increased in comparison with the atmospheric pressure within the switch storing chamber 105, there is a case in which the electrodes 101*a* and 103*a* come in contact with each other without performing any pressing operation, thereby causing an error in operation of the switch.

Therefore, in the conventional membrane switch 100, a concave groove is formed in the spacer sheet 102. Further, as shown in FIG. 18, a gas permeable passage 107 is formed by arranging an uncoating area of the adhesive material around the switch storing chamber 105 so that the switch storing chamber 105 is communicated with the exterior.

However, when the membrane switch 100 is wet with water, there is a case in which a water droplet enters the switch storing chamber 105 from this gas permeable passage 107 and is attached to the electrodes 101*a*, 103*a*. When an operating electric current of the switch flows through the electrodes 101*a*, 103*a* in this attaching state of the water droplet, a chemical change is caused by silver migration, etc. and causes insulation and contact defects, etc.

In recent years, carrying opportunities of the note type personal computer are increased and this personal computer is often exposed to the rain. Further, dew condensation tends to be caused by a change in temperature to move the personal computer to a place different in using environment. Accordingly, a more perfect waterproof property is required in the membrane switch. However, since it is necessary to form the gas permeable passage 107 as mentioned above, no sufficient waterproof performance is obtained.

SUMMARY OF THE INVENTION

To solve the above-mentioned problems, an object of this invention is to provide a membrane switch in which a switch storing chamber is communicated with the exterior of the switch and no water droplet enters the switch storing chamber.

To solve the above-mentioned problems, a membrane switch is provided in which an upper membrane sheet and a lower membrane sheet are laminated with each other through a spacer sheet forming adhesive material layers on both faces thereof; and a switch storing chamber having a pair of opposed electrodes printed on the upper membrane sheet and the lower membrane sheet by notching the spacer sheet is surrounded by the adhesive material layers except for a gas permeable passage communicated with the exterior and is isolated from the exterior; the membrane switch being characterized in that at least one upper gas permeable chamber is formed between the upper membrane sheet and the spacer sheet by surrounding a peripheral portion of this upper gas permeable chamber by the adhesive material layers, and at least one lower gas permeable chamber is formed between the lower membrane sheet and the spacer sheet by surrounding a peripheral portion of this lower gas permeable chamber by the adhesive material layers; the upper gas permeable chamber and the lower gas permeable chamber partially overlapping each other in a vertical direction are communicated with each other by a gas permeable hole of the spacer sheet bored in an overlapping position so that the gas permeable passage vertically curved in a zigzag shape is formed; and one side of the gas permeable passage is communicated with the exterior and the other side is communicated with the switch storing chamber.

The gas permeable passage is formed through the spacer sheet by using the upper gas permeable chamber above the spacer sheet and the lower gas permeable chamber below the spacer sheet. Accordingly, the gas permeable passage is vertically curved in a complicated zigzag shape so that a water droplet entering from the exterior is interrupted by the gas permeable passage. The slight entering water droplet stays and is naturally dried before this water droplet reaches the switch storing chamber. Accordingly, no water droplet is attached to the electrodes.

The membrane switch in one embodiment is characterized in that an external air entrance hole is bored in the upper membrane sheet or the lower membrane sheet, and one side of a gas permeable passage is communicated with the exterior, and the external air entrance hole is closed by a seal material transmitting only a gas.

Since the gas permeable passage is communicated with the exterior through the seal material transmitting only a gas, it is possible to more perfectly prevent the water droplet from entering the switch storing chamber.

The membrane switch in another embodiment is characterized in that a waterproof wall portion constructed by the same material as the electrodes is printed to the upper membrane sheet or the lower membrane sheet so as to cross the gas permeable passage at a height lower than heights of the adhesive material layers.

The waterproof wall portion can be formed by the same process as a printing process of the electrodes to the upper membrane sheet or the lower membrane sheet. A narrow gap is formed in a portion of the gas permeable passage forming the waterproof wall portion therein. Accordingly, the entering water droplet is naturally dried after the water droplet stays in a position of the waterproof wall portion by surface tension.

A membrane switch in a further embodiment is provided in which an upper membrane sheet and a lower membrane sheet are stuck to each other by an adhesive material and are laminated with each other; and a switch storing chamber having a pair of opposed electrodes printed to the upper membrane sheet and the lower membrane sheet is surrounded by an adhesive material layer except for a gas permeable passage communicated with the exterior, and the pair of electrodes are spaced from each other at a slight distance and are supported, and the switch storing chamber is isolated from the exterior; the membrane switch being characterized in that a waterproof wall portion constructed by the same material as the electrodes is printed to the upper membrane sheet or the lower membrane sheet so as to cross the gas permeable passage at a height lower than that of the adhesive material layer.

The insulating distance between the pair of electrodes is formed by the adhesive material layer surrounding the switch storing chamber. Since the waterproof wall portion is constructed by the same material as the electrodes, the waterproof wall portion can be formed by the same process as a printing process of the electrodes to the upper membrane sheet or the lower membrane sheet. A narrow gap is formed in a portion of the gas permeable passage forming the waterproof wall portion therein. Accordingly, the entering water droplet is naturally dried after the water droplet stays in a position of the waterproof wall portion by surface tension.

DESCRIPTION OF THE PREFERRED EMBODIMENTS

Figure 4:
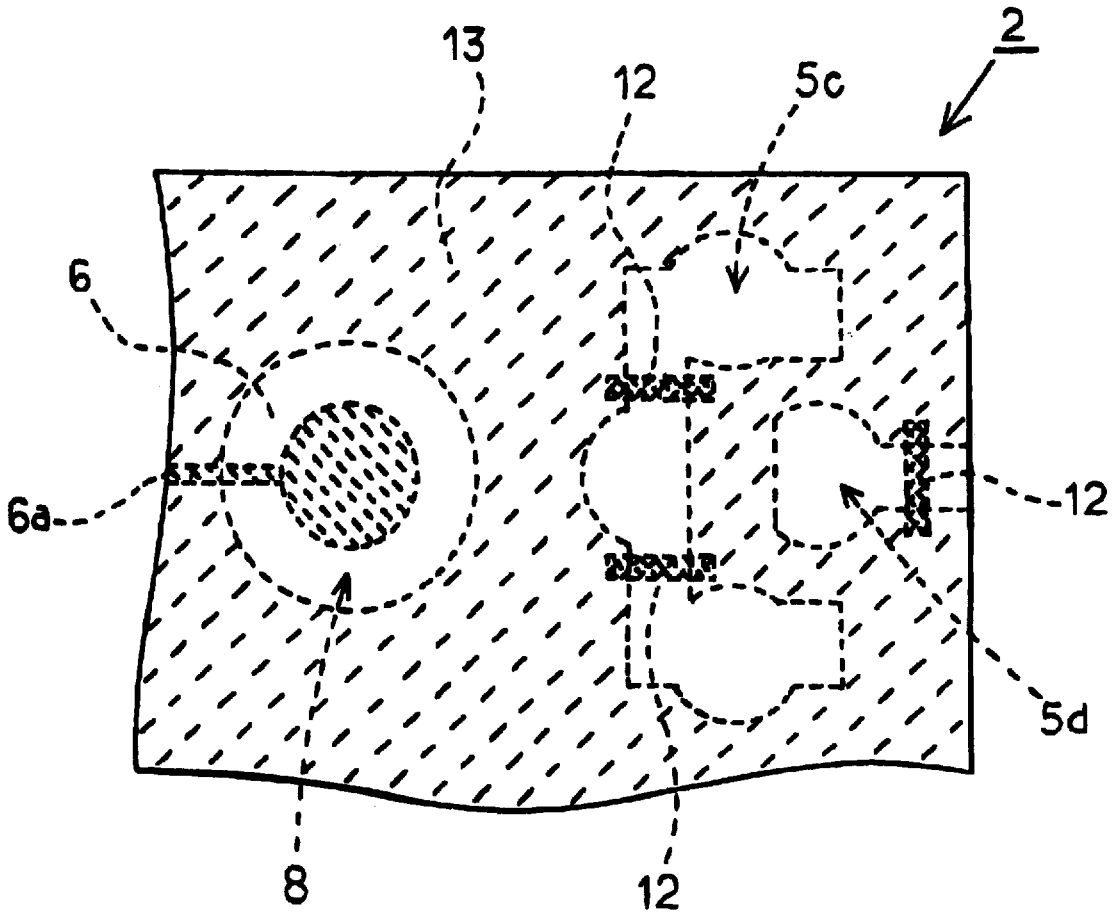
FIG. 4 is a partial plan view of an upper membrane sheet 2.
Figure 5:
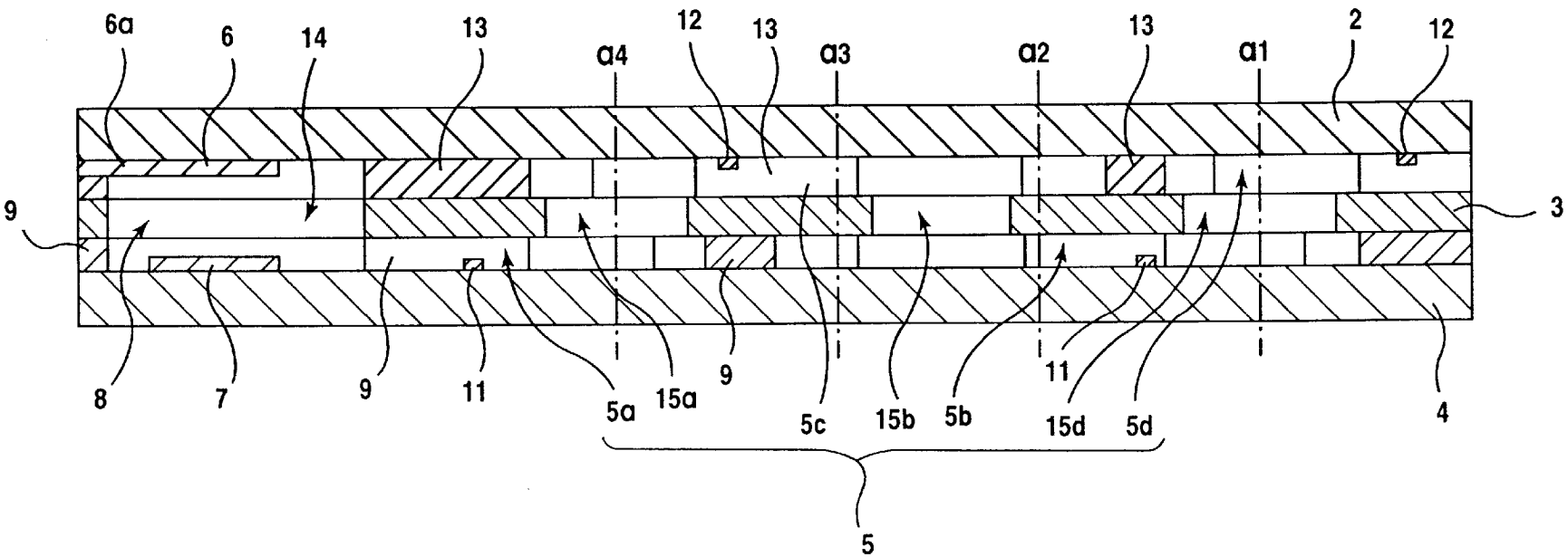
FIG. 5 is a combinational sectional view taken along lines A-$a_1$-$a_2$-$a_3$-$a_4$-A of FIG. 1.
Figure 6:
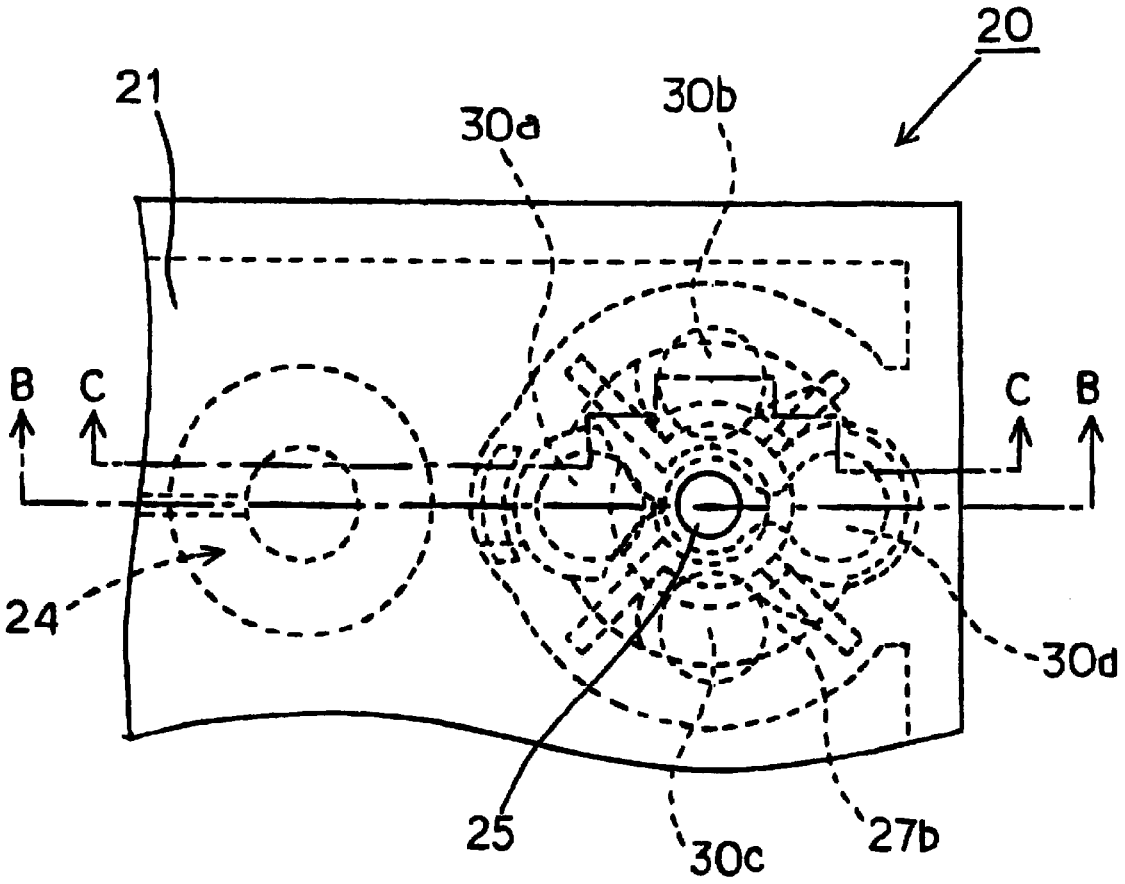
FIG. 6 is a partial plan view of a membrane switch 20 in accordance with a second embodiment mode of the present invention.

A membrane switch 1 in accordance with a first embodiment mode of the present invention will next be explained by FIGS. 1 to 5. FIGS. 1 to 4 are respectively partial plan views of the membrane switch 1, a lower membrane sheet 4, a spacer sheet 3 and an upper membrane sheet 2. FIG. 5 is a combinational sectional view taken along line A—A of FIG. 1.

As shown in these figures, the upper membrane sheet 2, the spacer sheet 3 and the lower membrane sheet 4 are formed by cutting a flexible synthetic resin film of PET (polyethylene terephthalate), etc. in the same contour shape in the membrane switch 1. These sheets are overlapped and integrated with each other by coating an adhesive material between these sheets. The laminated and integrated membrane switch 1 is supported on a rigid plate such as an unillustrated iron plate, etc. arranged within a box body of a device and is used as a keyboard switch exposed to a surface of the box body.

The membrane switch 1 has many key switches each constructed by a movable electrode 6 and a fixing electrode 7 as a pair. Predetermined key data are outputted in accordance with a pressing operation of each of the key switches. FIGS. 1 to 5 enlargedly show only portions of a switch storing chamber 8 for storing one of these key switches, and a gas permeable passage 5 for communicating the switch storing chamber 8 with its exterior.

Figure 2:
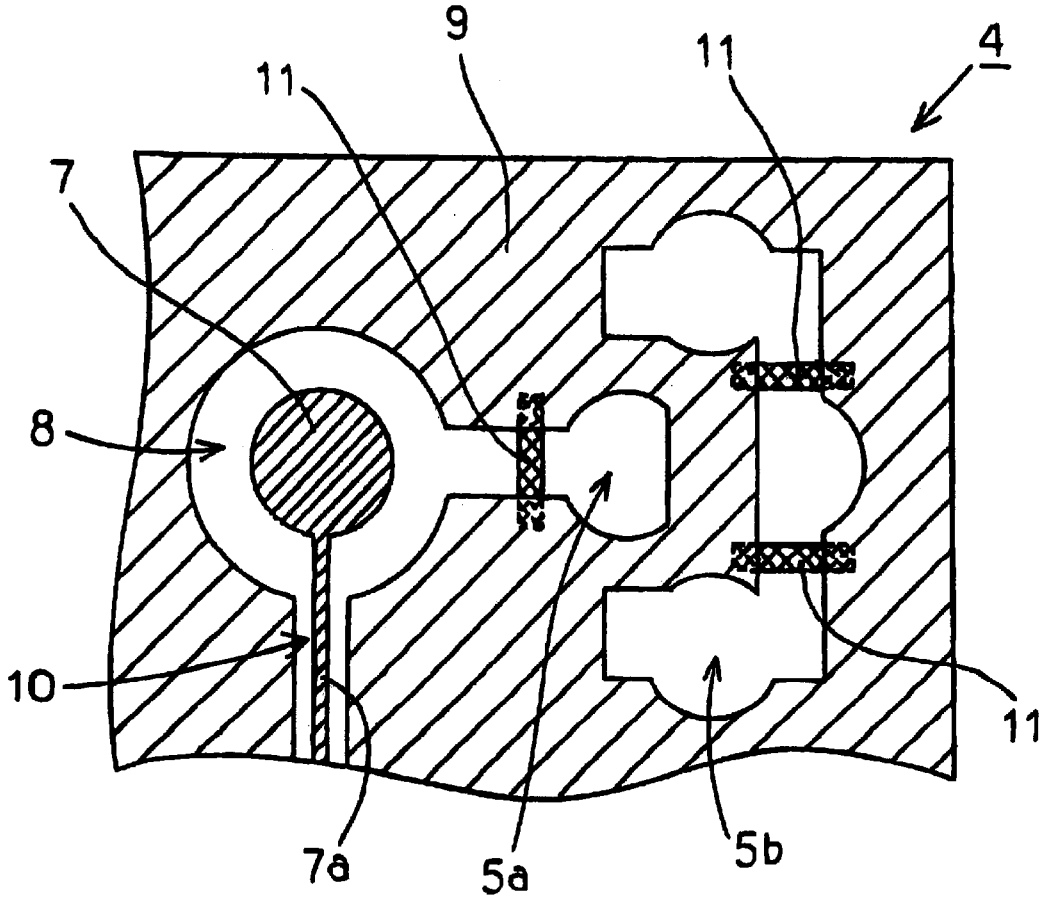
FIG. 2 is a partial plan view of a lower membrane sheet 4.

As shown in FIG. 2, the fixing electrode 7, a lead portion 7*a* extending from the fixing electrode 7, and a lower waterproof wall portion 11 are formed on the lower membrane sheet 4 by screen printing of silver paste. As described later, the fixing electrode 7 is formed in a circular shape at a center of the switch storing chamber 8 formed by surrounding this switch storing chamber 8 by an adhesive material layer 9. The lead portion 7*a* is pulled out of the fixing electrode 7 such that the fixing electrode 7 and an unillustrated external connecting portion are electrically connected to each other. The lower waterproof wall portion 11 is printed in the shape of a straight line such that the lower waterproof wall portion 11 crosses in three positions of a first lower gas permeable chamber 5*a* and second lower gas permeable chambers 5*b* by similarly surrounding this lower waterproof wall portion 11 by the adhesive material layer 9.

The lower membrane sheet 4 is coated with an adhesive material to stick the spacer sheet 3 to an upper face of the lower membrane sheet 4. However, contours of the switch storing chamber 8, the first lower gas permeable chamber 5*a* and the second lower gas permeable chambers 5*b* constituting the gas permeable passage 5, and an interswitch gas permeable passage 10 are formed by surrounding these chambers by this adhesive material layer 9 using an adhesive material.

Namely, the elongated first lower gas permeable chamber 5*a* is formed by coating the adhesive material except for an area of this chamber 5*a* such that this elongated first lower gas permeable chamber 5*a* continuously extends from the circular switch storing chamber 8 to its side. The interswitch gas permeable passage 10 having an elongated groove shape is formed by coating the adhesive material except for an area of this passage 10 such that this interswitch gas permeable passage 10 is continuously connected to an unillustrated another lower switch storing chamber 8. A second lower gas permeable chamber 5*b* having a U-shape on the right-hand side of the first lower gas permeable chamber 5*a* is formed by coating the adhesive material except for an area of this chamber 5*a*.

Thus, the lower waterproof wall portion 11 crosses three portions of the first lower gas permeable chamber 5*a* and the second lower gas permeable chambers 5*b*. However, crossing heights of the lower waterproof wall portion 11 are set to be equal to or lower than a thickness of the adhesive material layer 9 so that these gas permeable chambers 5*a*, 5*b* are not perfectly interrupted.

The upper membrane sheet 2 is approximately manufactured by the same process as the above lower membrane sheet 4. Namely, as shown in FIG. 4, a movable electrode 6, a lead portion 6*a* extending from the movable electrode 6 and an upper waterproof wall portion 12 are first formed on a lower face of the upper membrane sheet 2 by screen printing of silver paste. The movable electrode 6 is formed in a circular shape in a position opposed to the fixing electrode 7 through the lower membrane sheet 4 and the spacer sheet 3 in a laminated state (hereinafter called a laminating state). The lead portion 6*a* is pulled out of the movable electrode 6 such that the movable electrode 6 and an unillustrated external connecting portion are electrically connected to each other. The upper waterproof wall portion 12 is printed in the shape of a straight line such that the upper waterproof wall portion 12 crosses in three positions of first upper gas permeable chambers 5*c* and a second upper gas permeable chamber 5*d* formed by surrounding these chambers by an adhesive material layer 13. Crossing heights of the upper waterproof wall portion 12 are set to be equal to or lower than a thickness of the adhesive material layer 13.

Next, the adhesive material layer 13 for sticking the lower membrane sheet 4 to the spacer sheet 3 is formed on a lower face of the upper membrane sheet 2. Contours of the circular switch storing chamber 8 and the first upper gas permeable chambers 5*c* of an inverse U-shape and the elongated second upper gas permeable chamber 5*d* constituting the gas permeable passage 5 are formed by surrounding these chambers by the adhesive material layer 13.

In the laminating state, the circular switch storing chamber 8 is formed in a position above the contour of the switch storing chamber 8 formed in the lower membrane sheet 4. The first upper gas permeable chambers 5*c* are formed in positions in which a central connecting portion of the inverse U-shape is located above the first lower gas permeable chamber 5*a* and a forked arm portion of the inverse U-shape is located above a forked arm portion of the second lower gas permeable chamber 5*b* of the U-shape. In the laminating state, a left-hand end portion of the elongated second upper gas permeable chamber 5*d* is located above a central connecting portion of the second lower gas permeable chamber 5*b* of the U-shape and a right-hand end of the elongated second upper gas permeable chamber 5*d* is continuously connected from a side of the upper membrane sheet 2 to its exterior.

Figure 3:
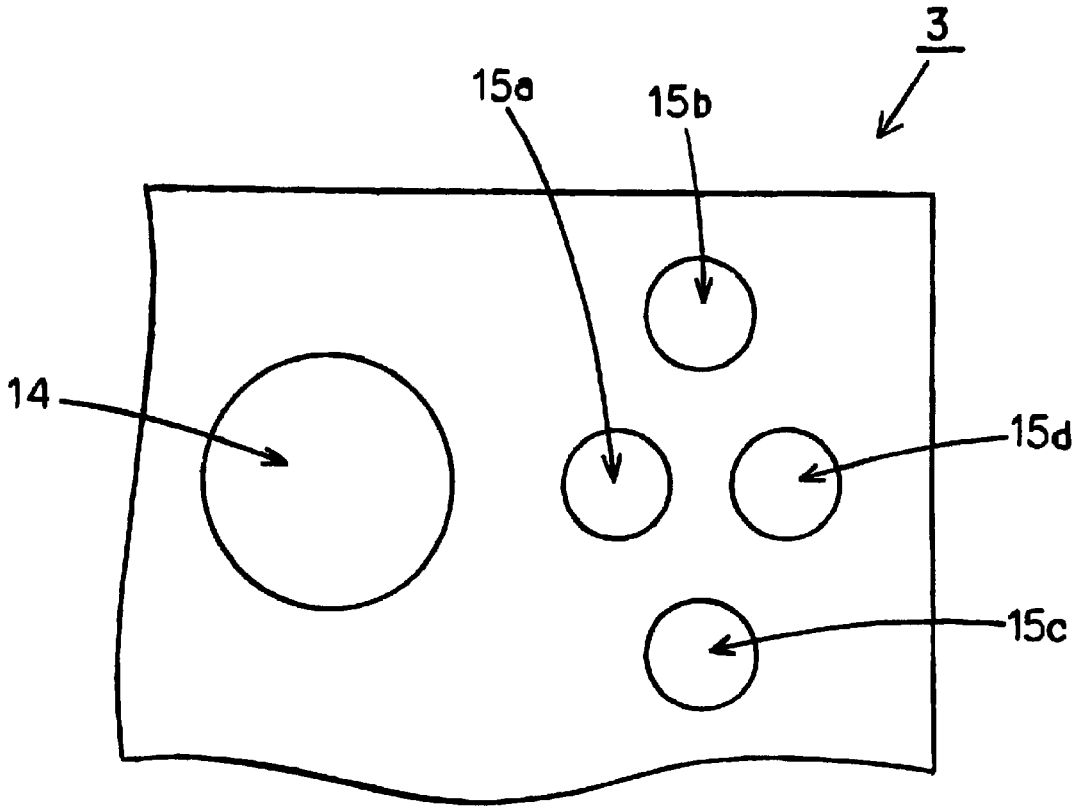
FIG. 3 is a partial plan view of a spacer sheet 3.

As shown in FIG. 3, a circular notch 14 is bored in the spacer sheet 3 in a portion corresponding to the contour of the switch storing chamber 8 in the laminating state. Circular gas permeable holes 15 (15*a*, 15*b*, 15*c*, 15*d*) are respectively bored in four positions of overlapping portions of the upper gas permeable chambers 5*c*, 5*d* and the lower gas permeable chambers 5*a*, 5*b*.

Accordingly, the upper gas permeable chambers 5*c*, 5*d* and the lower gas permeable chambers 5*a*, 5*b* are communicated with each other by the gas permeable holes 15.

Figure 1:
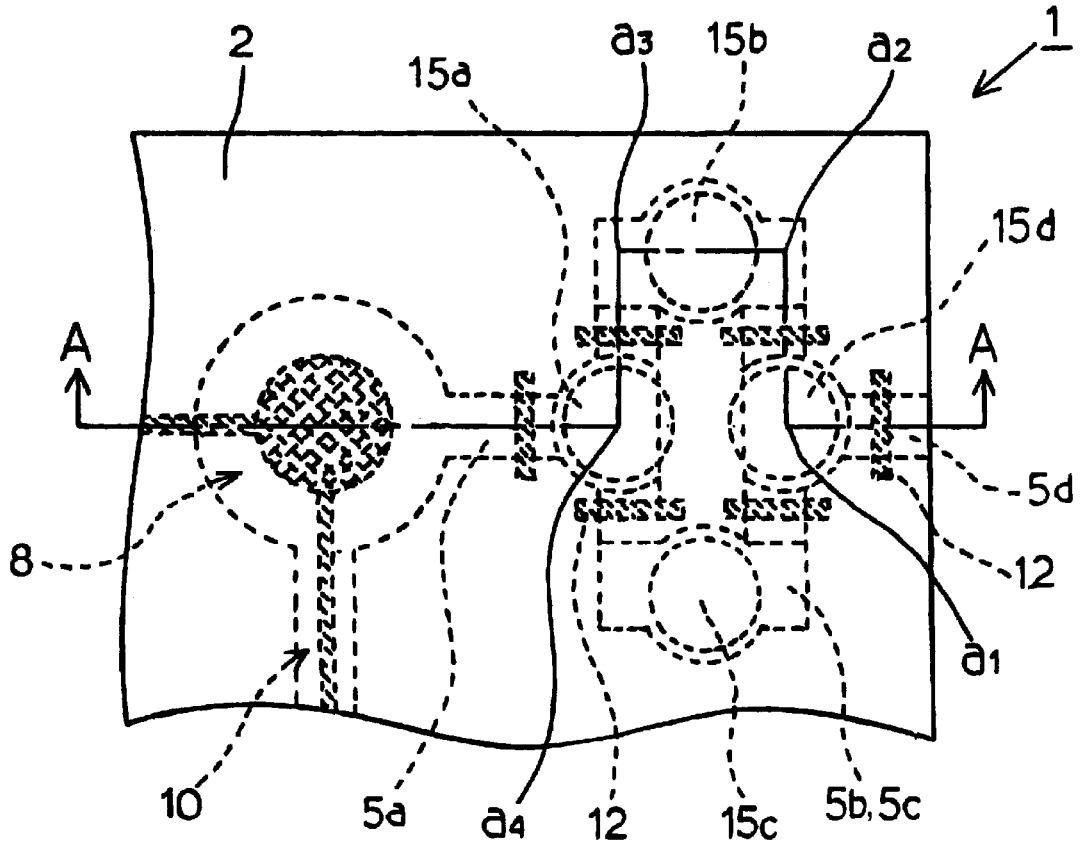
FIG. 1 is a partial plan view of a membrane switch 1 in accordance with a first embodiment mode of the present invention.

A structure of the membrane switch 1 formed by sticking the respective sheets 2, 3, 4 by the adhesive material layers 9, 13 will next be explained by FIG. 1 and FIG. 5 showing the membrane switch 1 by cutting this membrane switch 1 along the gas permeable passage 5.

When the spacer sheet 3 is stuck between the upper and lower membrane sheets 2 and 4, the switch storing chamber 8 located in a boring position of the notch 14 of the spacer sheet 3 is surrounded by the upper and lower membrane sheets 2, 4 and the adhesive material layers 9, 13 located between these sheets 2 and 4 so that this switch storing chamber 8 is isolated from the exterior. In the switch storing chamber 8, the movable electrode 6 and the fixing electrode 7 are opposed to each other with an insulating gap formed by the spacer sheet 3 and the upper and lower adhesive material layers 9, 13.

In this switch storing chamber 8, the interswitch gas permeable passage 10 and the first lower gas permeable chamber 5*a* are communicated with each other, and the other side of the interswitch gas permeable passage 10 is communicated with a switch storing chamber in which unillustrated other movable and fixing electrodes are opposed to each other.

As shown in FIG. 5, the other side (the right-hand side in FIG. 5) of the first lower gas permeable chamber 5*a* is communicated with the exterior via the gas permeable passage 15*a*, the central connecting portion of the inverse U-shape of the first upper gas permeable chamber 5*c*, the forked arm portion of the inverse U-shape of the first upper gas permeable chamber 5*c*, the gas permeable passage 15*b* (or 15*c*), the forked arm portion of the second lower gas permeable chamber 5*b*, the central connecting portion of the second lower gas permeable chamber 5*b*, the gas permeable passage 15*d*, and the second upper gas permeable chamber 5*d*.

Namely, the gas permeable passage 5 vertically curved in a zigzag shape and detoured to a fork on a plane is formed by the first lower gas permeable chamber 5*a*, the second lower gas permeable chamber 5*b*, the first upper gas permeable chamber 5*c*, the second upper gas permeable chamber 5*d*, and the gas permeable passages 15*a*, 15*b*, 15*c*. The switch storing chamber 8 isolated from the exterior is communicated with the exterior by this gas permeable chamber 5. Accordingly, the switch storing chamber 8 can be held at the same atmospheric pressure as the exterior at any time, and a water droplet entering the interior of the gas permeable passage 5 curved in a zigzag shape can be interrupted even when the membrane switch 1 is wet with water.

Further, in this embodiment mode, the lower waterproof wall portion 11 and the upper waterproof wall portion 12 are formed in six positions as mentioned above to more perfectly prevent the entry of the water droplet such that these wall portions cross the gas permeable passage 5. Since these waterproof wall portions 11, 12 are set to have thicknesses equal to or thinner than the thickness of the adhesive material layer 9, no waterproof wall portions 11, 12 prevent gas permeability of the gas permeable passage 5, but the gas permeable passage 5 is narrowed in forming positions of the waterproof wall portions 11, 12 so that the water droplet is prevented by surface tension from entering the interior. Thereafter, the water droplet staying in the waterproof wall portions 11, 12 is naturally dried.

Figure 10:
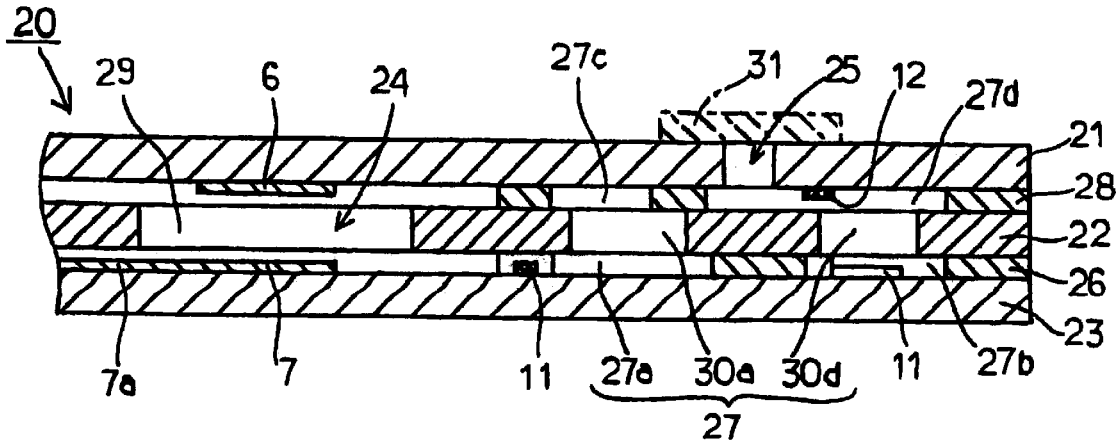
FIG. 10 is a longitudinal sectional view taken along line B—B of FIG. 6.
Figure 11:
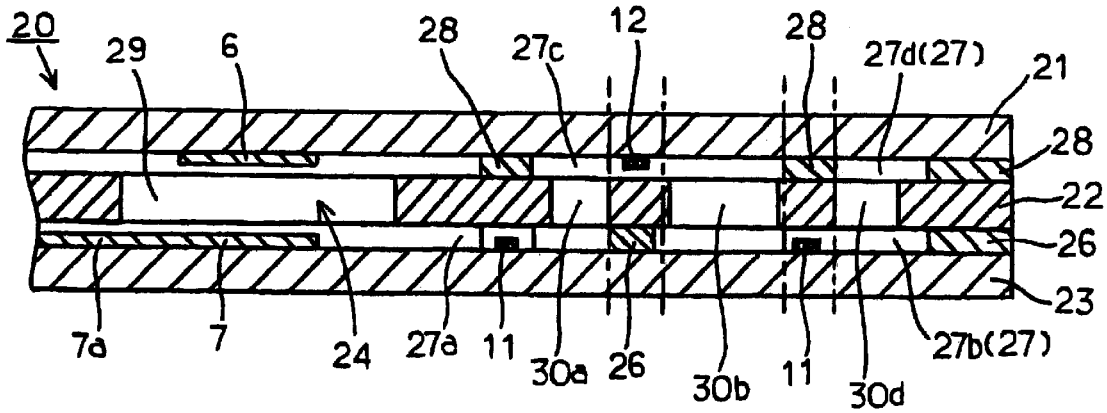
FIG. 11 is a combinational sectional view taken along line C—C of a gas permeable passage 27 of FIG. 6.
Figure 12:
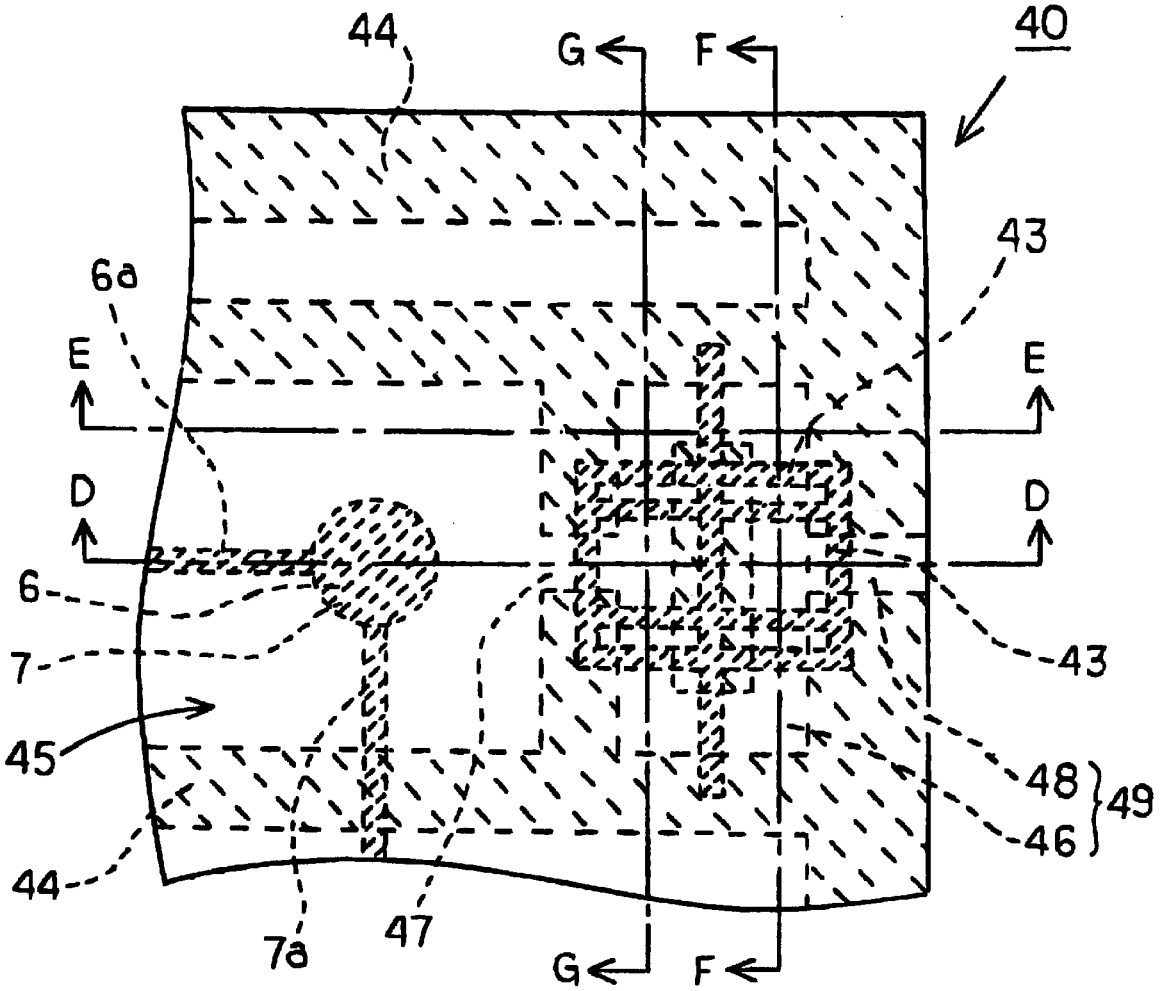
FIG. 12 is a partial plan view of a membrane switch 40 in accordance with a third embodiment mode of the present invention.
Figure 13:
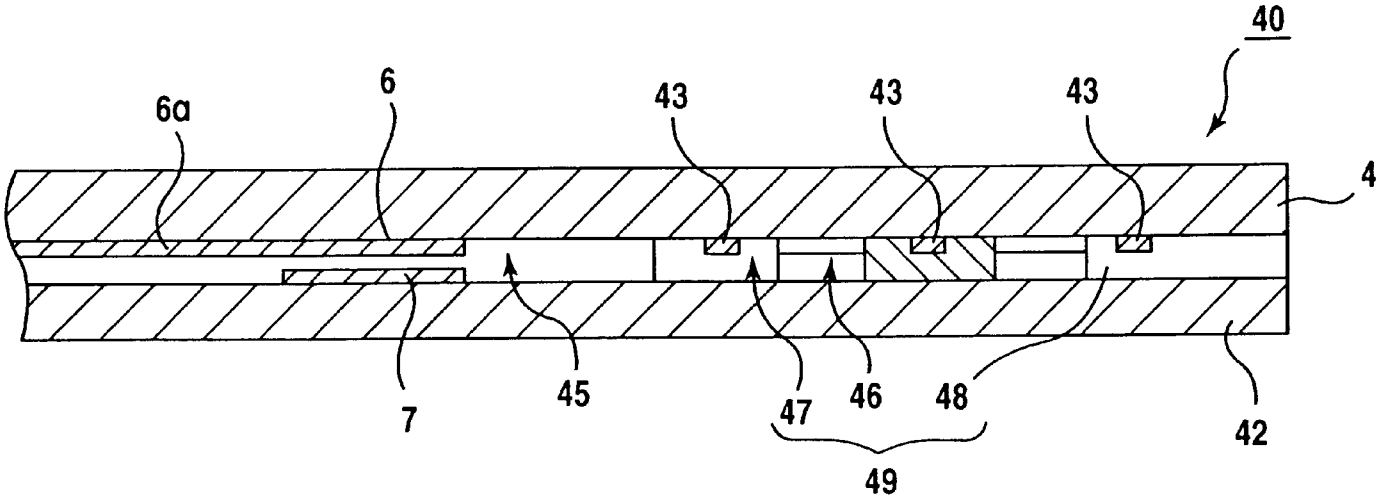
FIG. 13 is a longitudinal sectional view taken along line D—D of FIG. 12.
Figure 14:
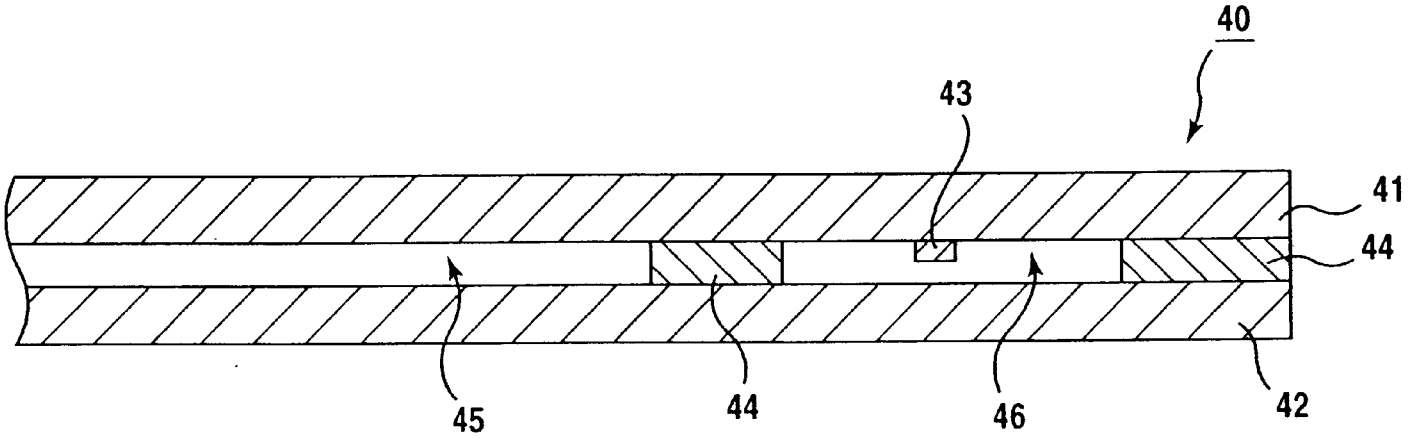
FIG. 14 is a longitudinal sectional view taken along line E—E of FIG. 12.
Figure 15:
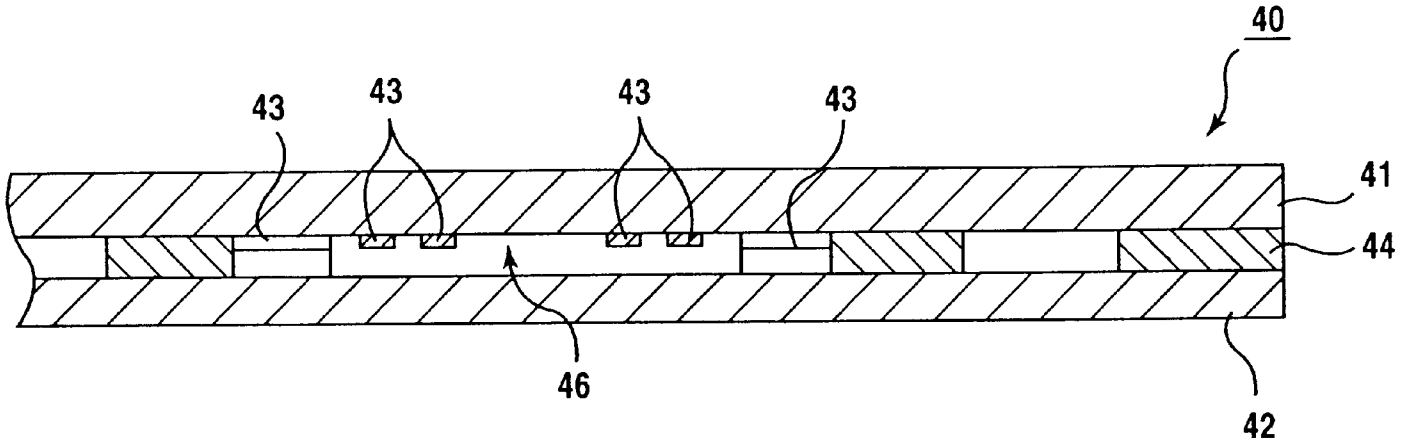
FIG. 15 is a longitudinal sectional view taken along line F—F of FIG. 12.
Figure 16:
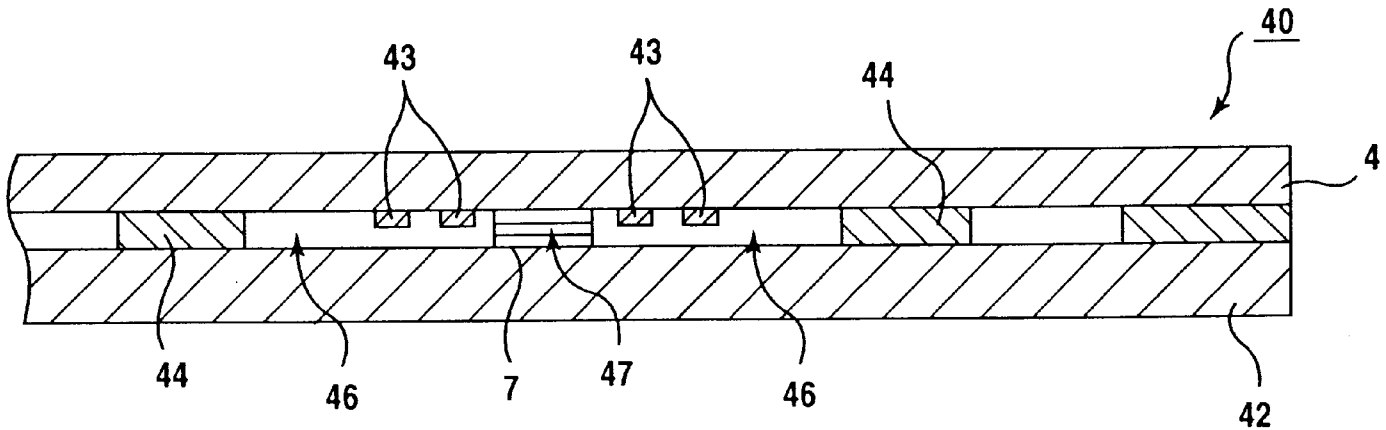
FIG. 16 is a longitudinal sectional view taken along line G—G of FIG. 12.
Figure 17:
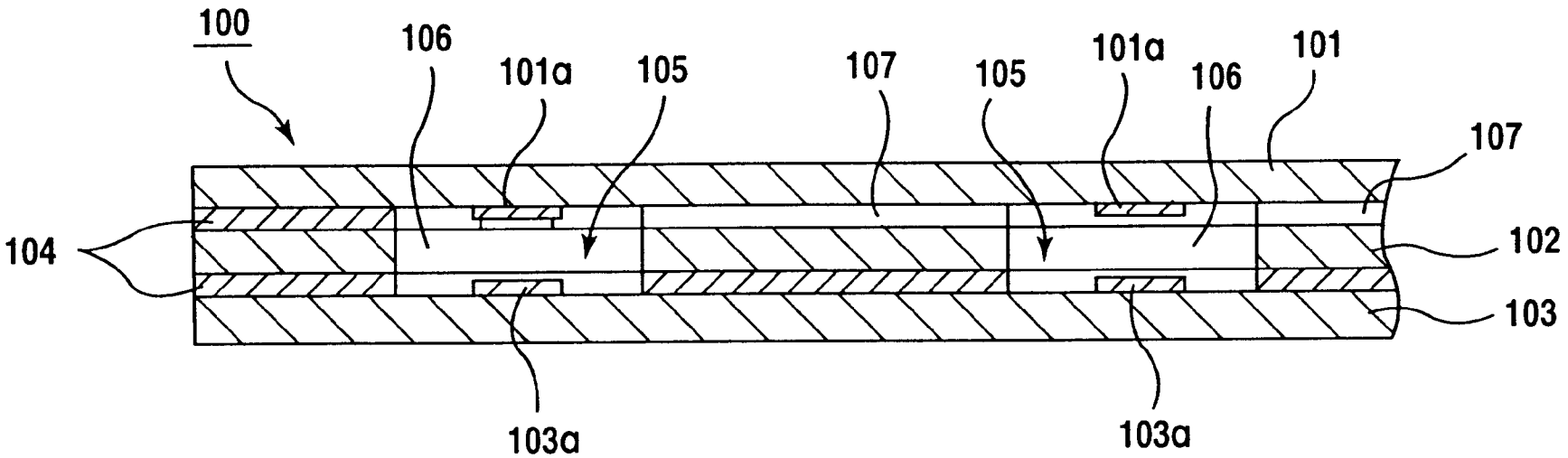
FIG.17 PRIOR ART
FIG. 17 is a longitudinal sectional view of a conventional membrane switch 100.
Figure 18:
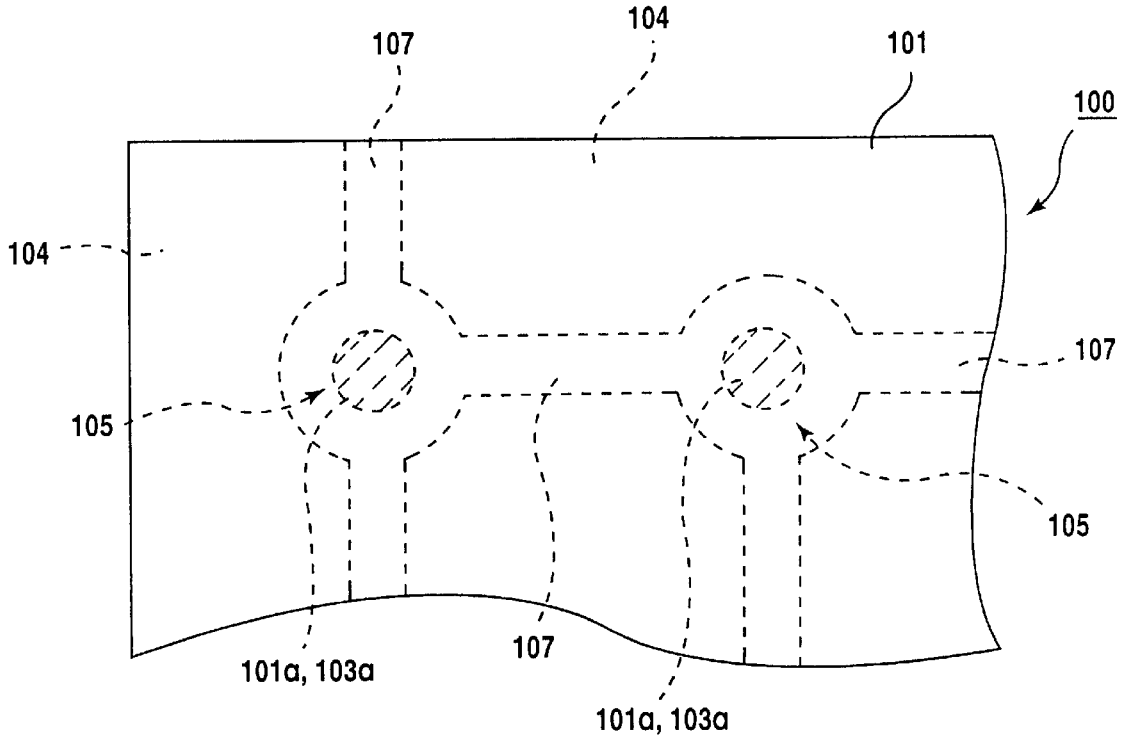
FIG.18 PRIOR ART
FIG. 18 is a partial plan view of the membrane switch 100.

FIGS. 6 to 11 show a membrane switch 20 in accordance with a second embodiment mode of the present invention. FIGS. 6 to 10 are respectively partial plan views of the membrane switch 20, a lower membrane sheet 21, a spacer sheet 22 and an upper membrane sheet 23. FIG. 11 is a sectional view taken along line B—B of FIG. 6. FIG. 12 is a combinational sectional view taken along line C—C of FIG. 6.

Similar to the first embodiment mode, in the membrane switch 20 in the second embodiment mode, the upper membrane sheet 21, the spacer sheet 22 and the lower membrane sheet 23 are formed by cutting a flexible synthetic resin film of PET in the same contour shape. An adhesive material is coated between these sheets and these sheets are overlapped and integrated with each other. Peripheral portions between the sheets 21, 22, 23 are perfectly interrupted by an adhesive material layer. A switch storing chamber 24 isolated within these sheets is communicated with the exterior from an external air entrance hole 25 bored in the upper membrane sheet 21.

This different construction will next be mainly explained. The explanation of a construction common to that in the first embodiment mode such as materials, manufacturing processes, operations, etc. is omitted by designating the same reference numerals.

Figure 7:
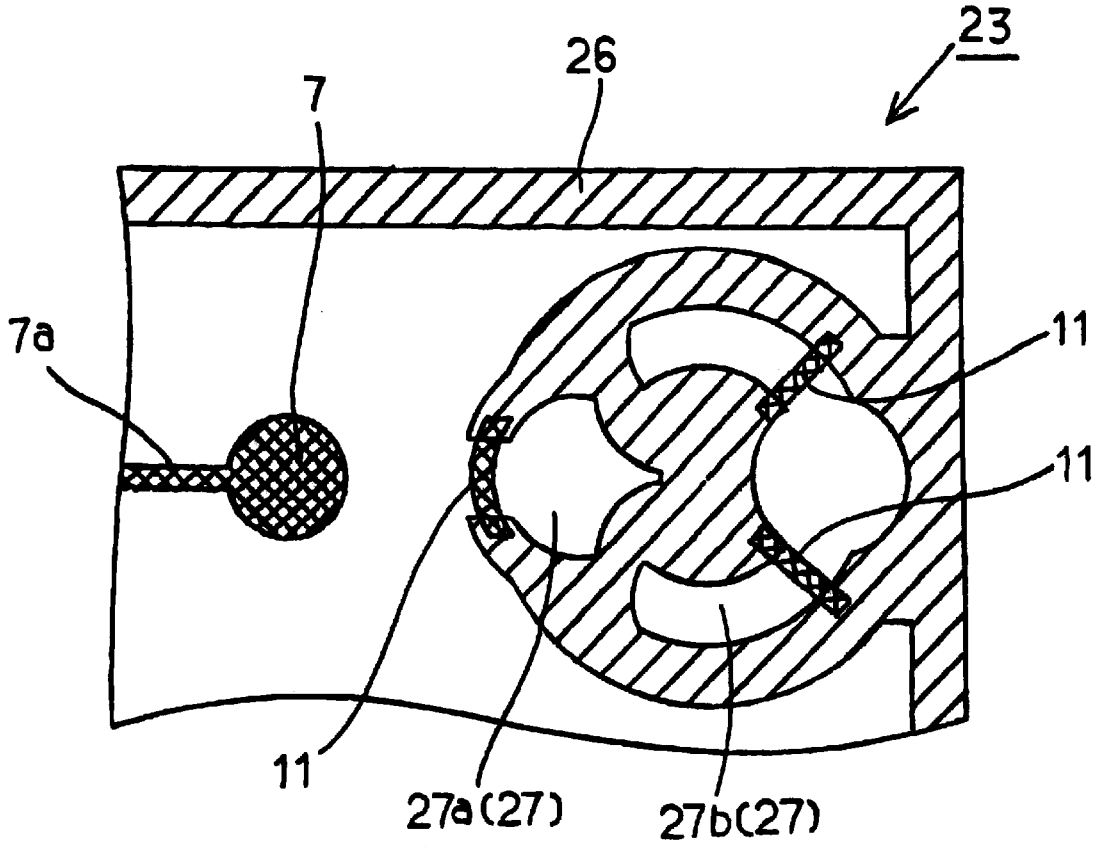
FIG. 7 is a partial plan view of a lower membrane sheet 23.

As shown in FIG. 7, the lower membrane sheet 23 printing a fixing electrode 7, a lead portion 7*a* extending from the fixing electrode 7 and a lower waterproof wall portion 11 thereon is coated with an adhesive material for sticking the spacer sheet 22. An adhesive material layer 26 formed by coating this adhesive material is formed in the entire circumference of a contour of the lower membrane sheet 23. The contours of a first lower gas permeable chamber 27*a* and a second lower gas permeable chamber 27*b* of a U-shape are formed by surrounding these chambers by the adhesive material layer 26. The first lower gas permeable chamber 27*a* is opened at one end thereof and has a fan shape.

A movable electrode 6 of silver paste, a lead portion 6*a* extending from the movable electrode 6 and an upper waterproof wall portion 12 are printed on a lower face of the upper membrane sheet 21. An adhesive material layer 28 for sticking the lower membrane sheet 23 to the spacer sheet 22 is formed on the above printed lower face of the upper membrane sheet 21 by coating an adhesive material.

The adhesive material layer 28 is also formed in the entire circumference of a contour of the upper membrane sheet 21. The contours of a first upper gas permeable chamber 27*c* of an inverse U-shape constituting a gas permeable passage 27, and a second upper gas permeable chamber 27*d* of a gourd-shaped type are formed by surrounding these chambers by the adhesive material layer 26. A circular external air entrance hole 25 is bored in the position of a left-hand side circular portion of the second upper gas permeable chamber 27*d* of a gourd-shaped type formed in the upper membrane sheet 21.

In an overlapping state of the respective sheets 21, 22, 23, a central portion of the first upper gas permeable chamber 27*c* of a C-shape is located above the first lower gas permeable chamber 27*a* of a fan shape. A fork portion of the inverse U-shape of the first upper gas permeable chamber 27*c* is located above a fork portion of the second lower gas permeable chamber 27*b* of a U-shape. A right-hand side circular portion of the second upper gas permeable chamber 27*d* of a gourd-shaped type is located above a central portion of the second lower gas permeable chamber 27*b* of a U-shape.

Figure 8:
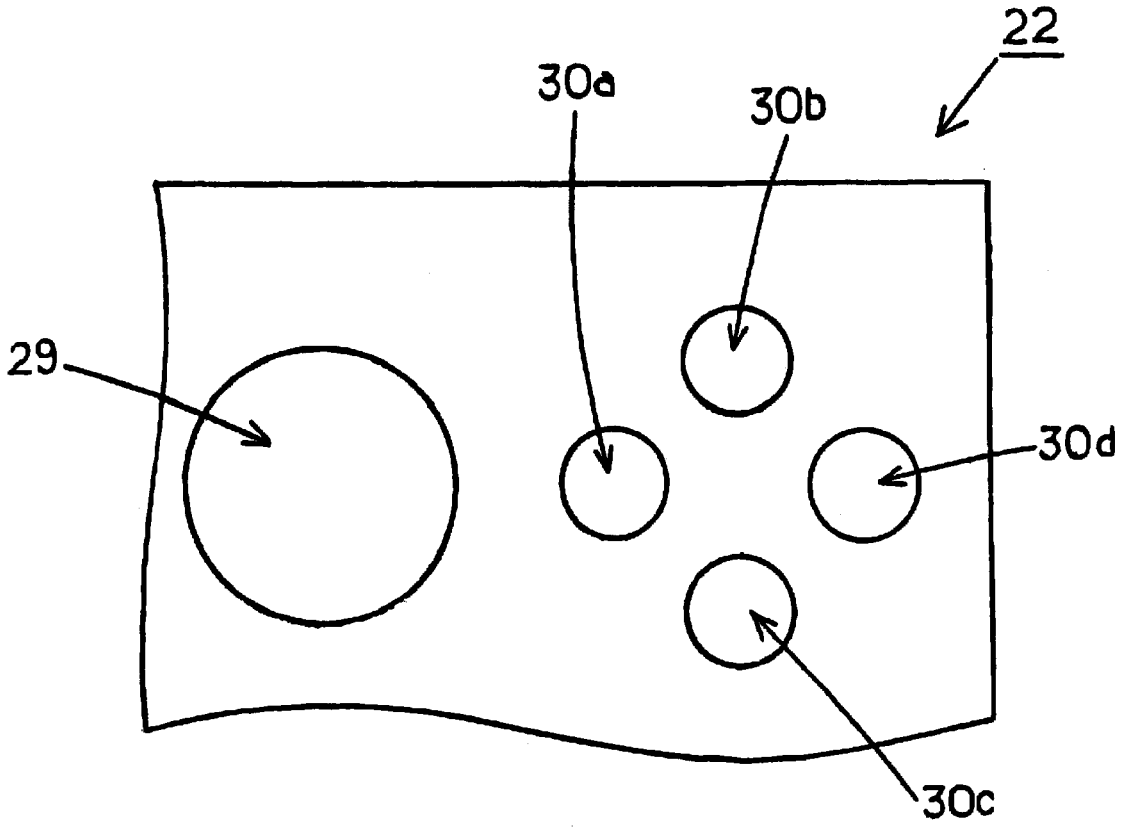
FIG. 8 is a partial plan view of a spacer sheet 22.
Figure 9:
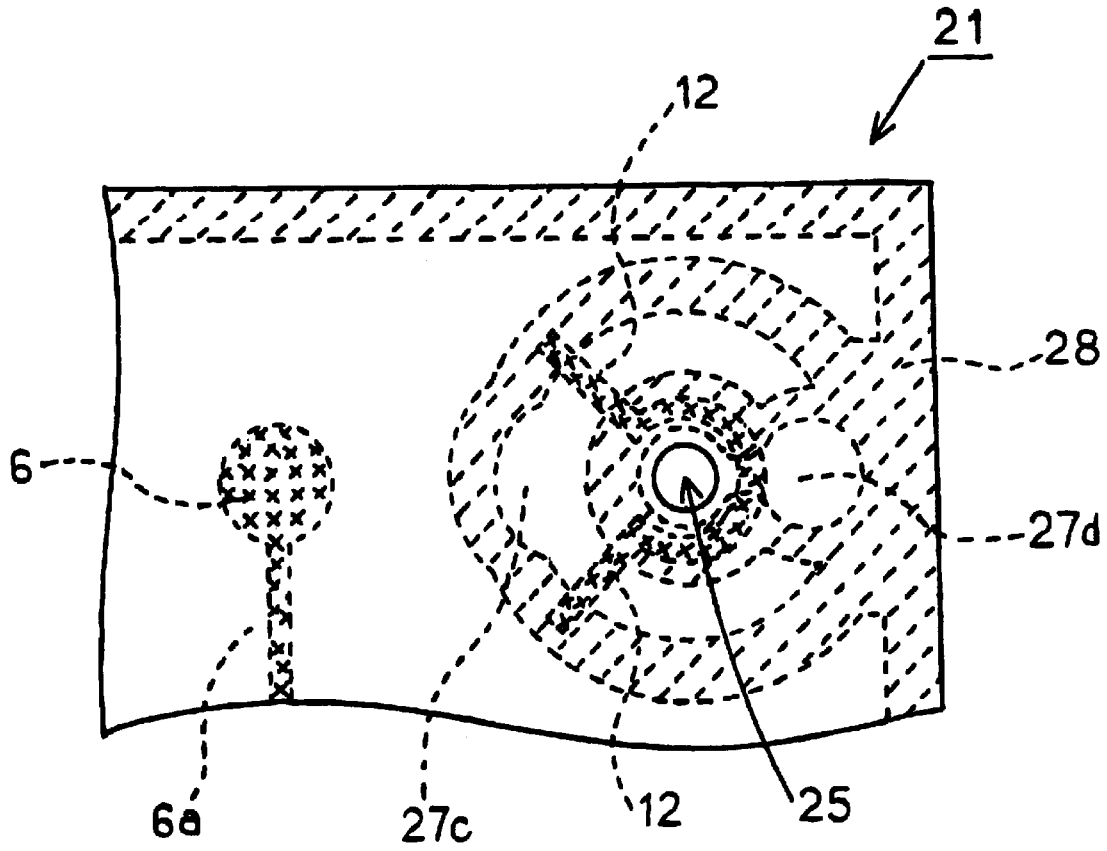
FIG. 9 is a partial plan view of an upper membrane sheet 21.

As shown in FIG. 8, in the spacer sheet 22, a circular notch 29 is bored in a portion corresponding to the switch storing chamber 24 in which the movable electrode 6 and the fixing electrode 7 are opposed to each other. Further, circular gas permeable holes (30*a*, 30*b*, 30*c*, 30*d*) are respectively bored in four positions in which the above upper gas permeable chambers 27*c*, 27*d* and the lower gas permeable chambers 27*a*, 27*b* overlap each other. Accordingly, the upper gas permeable chambers 27*c*, 27*d* and the lower gas permeable chambers 27*a*, 27*b* are communicated with each other by the gas permeable holes 30.

When the spacer sheet 22 is stuck between the upper and lower membrane sheets 21 and 23 constructed above, peripheral portions of the upper and lower membrane sheets 21, 23 are surrounded by the adhesive material layers 26, 28 so that many switch storing chambers 24 formed within these sheets are isolated from the exterior. In each of the switch storing chambers 24, the movable electrode 6 and the fixing electrode 7 are opposed to each other with an insulating gap formed by the spacer sheet 22 and the upper and lower adhesive material layers 26, 28.

As shown in FIGS. 10 and 11, this switch storing chamber 24 is communicated with the exterior via the first lower gas permeable chamber 27*a*, the gas permeable passage 30*a*, the central portion of the inverse U-shape of the first upper gas permeable chamber 27*c*, the fork portion of the inverse U-shape of the first upper gas permeable chamber 27*c*, the gas permeable passage 30*b* (or 30*c*), the fork portion of the second lower gas permeable chamber 27*b*, the central portion of the second lower gas permeable chamber 27*b*, the gas permeable passage 30*d*, the right-hand side circular portion of the second upper gas permeable chamber 27*d*, the left-hand side circular portion of this second upper gas permeable chamber 27*d*, and the external air entrance hole 25.

Namely, the gas permeable passage 27 vertically curved in a zigzag shape and detoured to a fork on a plane is formed by the first lower gas permeable chamber 27*a*, the second lower gas permeable chamber 27*b*, the first upper gas permeable chamber 27*c*, the second upper gas permeable chamber 27*d*, the gas permeable passages 30*a*, 30*b*, 30*c* and the external air entrance hole 25. The switch storing chamber 24 isolated from the exterior is communicated with the exterior by this gas permeable passage 27. Thus, the entry of a water droplet is prevented. However, in this embodiment mode, to further reliably prevent the entry of the water droplet, a waterproof gas permeable sheet 31 is further stuck to an upper face of the upper membrane sheet 21 so as to cover the external air entrance hole 25 (see FIG. 10). This waterproof gas permeable sheet 31 is molded in a sheet shape by condensing water repellent fibers and has characteristics in which a liquid is interrupted by this sheet and only a gas passes through this sheet. In accordance with this embodiment mode, the gas permeable passage 27 is opened on a plane instead of a side of the membrane switch 20 so that the waterproof gas permeable sheet 31 can be simply stuck to an opening portion of the gas permeable passage 27.

In this embodiment mode, a lower waterproof wall portion 11 and an upper waterproof wall portion 12 are formed so as to cross the gas permeable passage 27 in six positions so that the entry of the water droplet can be further perfectly prevented.

In these embodiment modes, the lower waterproof wall portion 11 and the upper waterproof wall portion 12 are formed so as to cross the gas permeable passage 27 curved in a zigzag shape above and below the spacer sheet 22. However, the waterproof wall portions can be formed with respect to a gas permeable passage of a membrane switch having no spacer sheet.

FIGS. 12 to 16 show a membrane switch 40 in accordance with this third embodiment mode. An upper membrane sheet 41 and a lower membrane sheet 42 are formed by cutting a flexible synthetic resin film in the same contour shape. These sheets are overlapped and integrated with each other by coating an adhesive material between these sheets.

In the third embodiment mode, the explanation of a construction overlapping that in the above embodiment modes is omitted by designating the same reference numerals.

As shown in these figures, a fixing electrode 7 and a lead portion 7*a* extending from the fixing electrode 7 are formed by screen printing of silver paste on an upper face of the lower membrane sheet 42. A movable electrode 6, a lead portion 6*a* extending from the movable electrode 6, and a waterproof wall portion 43 are formed by screen printing of silver paste on a lower face of the upper membrane sheet 41.

As shown in FIG. 12, contours of the upper membrane sheet 41 and the lower membrane sheet 42 are surrounded by an adhesive material layer 44 formed by coating an adhesive material except for a third gas permeable chamber 48. Thus, all switch storing chambers 45 within the membrane switch 40 having the fixing electrode 7 and the movable electrode 6 opposed to each other are isolated from the exterior.

Further, a switch storing chamber 45, a rectangular first gas permeable chamber 46, a second gas permeable chamber 47 for communicating the first gas permeable chamber 46 with the switch storing chamber 45, and the third gas permeable chamber 48 for communicating the first gas permeable chamber 46 with he exterior are formed by surrounding these chambers by the adhesive material layer 44. A gas permeable passage 49 for communicating the switch storing chamber 45 with the exterior is formed by these gas permeable chambers 46, 47, 48. The fixing electrode 7 and the movable electrode 6 within the switch storing chamber 45 are opposed to each other with a slight gap and are supported by the surrounding adhesive material layer 44.

The waterproof wall portion 43 is printed to the upper membrane sheet 41 so as to cross the gas permeable passage 49 in ten positions. Accordingly, the gas permeable passage 49 is narrowed in a position of this waterproof wall portion 43 and the entry of a water droplet from the gas permeable passage 49 to the interior of the switch storing chamber is prevented by surface tension so that the entry of the water droplet into the switch storing chamber 45 can be prevented.

The present invention is not limited to the above embodiment modes, but can be variously modified. For example, in the first and second embodiment modes, waterproof effects can be sufficiently obtained only by curving the gas permeable passage in a zigzag shape, and the waterproof wall portions may not be necessarily formed.

In the third embodiment mode, the waterproof wall portion 43 is formed on a side of the upper membrane sheet 41, but may be printed and formed on a side of the lower membrane sheet 42.

Further, the construction of the gas permeable passage is explained by enlarging only one portion of the membrane switch, but gas permeable passages may be also arranged in plural portions of the membrane switch.

In accordance with the invention of claim 1, the switch storing chamber is communicated with the exterior by the gas permeable passage. Accordingly, a pressing operation of the switch can be performed by weak pressing force and there is no error in operation of the switch even when the pressure of an external air is increased.

Further, the gas permeable passage vertically curved in a complicated zigzag shape through the spacer sheet can be formed only by forming the adhesive material layer in a specific position and boring a gas permeable hole in a spacer. Accordingly, no water droplet enters the switch storing chamber through the gas permeable passage.

In addition to this, in accordance with the invention of claim 2, the gas permeable passage is communicated with the exterior through a seal material transmitting only a gas so that the entry of the water droplet into the switch storing chamber can be more perfectly prevented.

In accordance with the inventions of claims 3 and 4, the waterproof wall portions can be formed by the same process as a printing process of an electrode to the upper membrane sheet or the lower membrane sheet. Accordingly, the water droplet entering the gas permeable passage can be more reliably interrupted by the waterproof wall portions.

What is claimed is:

1. A membrane switch in which an upper membrane sheet and a lower membrane sheet are laminated with each other through a spacer sheet having therein a bore and forming adhesive material layers on an upper and a lower face thereof, respectively, comprising:

a switch storing chamber, provided in the bore of the spacer sheet, for storing a pair of opposed electrodes printed on the upper membrane sheet and the lower membrane sheet, respectively, said switch storing chamber being enclosed, except for a gas permeable passage for communicating the switch storing chamber with the exterior, by the adhesive material layers so that the switch chamber is isolated from the exterior;

at least one upper gas permeable chamber formed between the upper membrane sheet and the spacer sheet by surrounding a peripheral portion of the upper gas permeable chamber by the adhesive material layer, and at least one lower gas permeable chamber formed between the lower membrane sheet and the spacer sheet by surrounding a peripheral portion of the lower gas permeable chamber by the adhesive material layer; and the at least one upper gas permeable chamber and the at least one lower gas permeable chamber partially overlapping with each other in a vertical direction of the membrane switch, said upper and lower permeable chambers communicating through a gas permeable hole provided in the spacer sheet at an overlapping position of the upper gas permeable chamber and the lower gas permeable chamber, said upper and lower gas permeable chambers and said gas permeable hole forming a gas permeable passage vertically curved in a zigzag shape, wherein one side of the gas permeable passage communicates with the exterior and another side of the gas permeable passage communicates with the switch storing chamber.

2. The membrane switch as defined in claim 1, wherein an external air entrance hole is bored in the upper membrane sheet or the lower membrane sheet, and one side of said gas permeable passage is communicated with the exterior, and the external air entrance hole is closed by a seal material transmitting only a gas.

3. The membrane switch as defined in claim 1 or 2, wherein a waterproof wall portion made of a same material as the electrodes is printed on the upper membrane sheet or the lower membrane sheet, and a thickness of the waterproof wall portion is less than that of the adhesive material layers.

4. A membrane switch in which an upper membrane sheet and a lower membrane sheet are stuck to each other by an adhesive material and are laminated with each other, comprising:

a switch storing chamber for storing a pair of opposed electrodes printed on the upper membrane sheet and the lower membrane sheet, respectively, said switch storing chamber being enclosed, except for a gas permeable passage for communicating the switch storing chamber with the exterior, by an adhesive material layer comprised of the adhesive material so that the switch storing chamber is isolated from the exterior, the pair of electrodes being supported by the upper and lower membrane sheets such that the pair of electrodes are spaced from each other, wherein a waterproof wall portion made of a same material as the electrodes is printed on the upper membrane sheet or the lower membrane sheet so that the waterproof wall crosses the gas permeable passage, and the thickness of the waterproof wall portion is less than that of the adhesive material layer.

* * * * *